US006171001B1

(12) United States Patent
Nonaka

(10) Patent No.: US 6,171,001 B1
(45) **Date of Patent: *Jan. 9, 2001**

(54) HEAD GAP ADJUSTING DEVICE FOR PRINTER

(75) Inventor: Tadashi Nonaka, Shizuoka (JP)

(73) Assignee: Star Micronics Co., Ltd., Shizuoka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/098,650

(22) Filed: Jun. 17, 1998

(30) Foreign Application Priority Data

Jul. 18, 1997 (JP) ..... 9-210098

(51) Int. Cl.[7] ..... B41J 11/20

(52) U.S. Cl. ..... 400/58; 400/55; 400/648; 400/649

(58) Field of Search ..... 400/58, 57, 56, 400/55, 648, 649, 656, 672, 175

(56) References Cited

U.S. PATENT DOCUMENTS

| | | | | |
|---|---|---|---|---|
| 4,120,245 | | 10/1978 | Karp et al. | 101/288 |
| 4,184,780 | * | 1/1980 | Kurihara et al. | 400/56 |
| 4,632,577 | * | 12/1986 | Brull et al. | 400/56 |
| 4,738,552 | * | 4/1988 | Kikuchi | 400/59 |
| 4,780,007 | * | 10/1988 | Weeks et al. | 400/56 |
| 4,900,175 | * | 2/1990 | Ikeda et al. | 400/659 |
| 4,994,988 | * | 2/1991 | Yokoi | 364/519 |
| 5,316,395 | * | 5/1994 | Imai | 400/56 |
| 5,547,292 | * | 8/1996 | Harada | 400/58 |
| 5,619,244 | * | 4/1997 | Manna | 347/214 |
| 5,672,015 | * | 9/1997 | Lyerly et al. | 400/58 |
| 5,815,171 | * | 9/1998 | Brugue | 400/55 X |

FOREIGN PATENT DOCUMENTS

| | | |
|---|---|---|
| 143467A | 6/1985 | (EP) . |
| 347217A | 12/1989 | (EP) . |
| 61-35846 | 3/1986 | (JP) . |
| 1-76247 | 5/1989 | (JP) . |

* cited by examiner

*Primary Examiner*—John S. Hilten
*Assistant Examiner*—Minh H. Chau
(74) *Attorney, Agent, or Firm*—Scully, Scott, Murphy & Presser

(57) ABSTRACT

Disclosed are printers capable of easy and precise head gap adjustment. In the printer, a cam mechanism 61 consisting of a fixed cam 62 and a rotatable cam 63 put between each end of a platen 10 and a swing frame 4. The platen 10 is normally biased to the swing frame 4 by a torsion coil spring 14. A driving gear 64 rotatably supported on the swing frame 4 is engaged with a driven gear 63*a* formed on the rotatable cam 63. The driving gear 64 is rotated by an operating tool 66 inserted from above, whereby the rotatable cam 63 is rotated by gear drive. In accordance with the rotation of the rotatable cam 63, the platen 10 vertically moves with the fixed cam 62, whereby head gap with respect to a printing head is adjusted. The driving gear 64 can be unrotatable by securing a screw 65 as a rotatable axis thereof by operation from above, whereby the platen 10 is secured.

11 Claims, 4 Drawing Sheets

HEAD GAP ADJUSTING DEVICE FOR PRINTER

BACKGROUND OF THE INVENTION

1. Field of the Invention

The present invention relates to a printer for printing on single paper such as a slip, more specifically to an improvement of an adjusting means for a head gap which is provided in a given distance between a platen and a printing head and a securing means of the head gap adjusting means for maintaining the head gap.

2. Description of the Prior Art

Slip printers for printing on slip paper are conventionally constructed such that slip paper inserted through a side portion or a front portion of the printer is received by a printing device, and the printing device performs printing operation. The printing device is equipped with a platen and a printing head which is disposed above and opposing the platen. Slip paper is inserted into a given opening, namely a head gap provided between the platen and the printing head. The printing head performs printing on the slip paper supported on the platen. In order to obtain stable printed images, distance of the head gap must be uniform over the entire width of the platen. Therefore, the manufacturer normally adjusts head gaps before shipment of printers.

As a structure for adjusting head gap, for example, Japanese Unexamined Utility Model Publication (Kokai) No. 61-35846 discloses a structure, in which a platen can be moved up and down by rotating screws screwed on both ends of the platen. The screws can be rotated by operation from above, and after completion of the adjustment; the platen is secured by tightening securing screws, which penetrate a frame from the side thereof. Furthermore, Japanese Unexamined Utility Model Publication (Kokai) No. 1-76247 discloses a structure installed with an adjusting roller. The adjusting roller has a spiral inclined portion on its peripheral portion. The spiral inclined portion is inserted into a slit-shaped aperture formed on the both ends of a platen so as to move the platen up and down by virtue of the inclined portion when the adjusting roller is rotated. In this case, a plurality of claw portions formed on the outer surface of the adjusting roller engage with a securing claw portion so as to restrict rotation of the adjusting roller, whereby the adjusted position of the platen is fixed.

SUMMARY OF THE INVENTION

In the former case of the prior arts disclosed in the above publications, the head gap adjusting operation by way of moving up and down the platen is performed by rotating the adjusting screw from above thereof. However, the securing operation for keeping the gap must be performed by way of tightening the securing screws from the side. Therefore, the adjusting steps, which are adjusting the head gap and securing the platen can not be smoothly performed, whereby the operation efficiency is inferior. Moreover, the securing screw inserted through the frame is tightened to the platen, so that strain occurs in the frame due to the tightening force, affecting the platen, whereby the adjusted head gap may change.

On the other hand in the later case, in order to rotate the adjusting roller, an operation tool such as a driver or the like must be used from the reverse side of the apparatus. And therefore, the adjusting operation with measuring head gap is troublesome, whereby the operation efficiency is inferior.

Therefore, an object of the present invention is to provide a printer in which head gap adjusting operation by way of moving a platen up and down and securing the platen can be easily performed.

In accordance with the invention, there is provided a printer comprising a frame, a platen mounted on the frame via a head gap adjusting means, a printing head disposed opposing the platen with a given gap provided therebetween, and a securing means of the head gap adjusting means for fixing the gap. Both the head gap adjusting means and the securing means are provided on said frame operatably from above.

Generally, printers are normally used on a working table, etc. As printers are precision apparatus, they should not be inclined or reversed. In addition, as printers have a certain weight each, it is troublesome to move them. According to the invention, the head gap adjusting means and the securing means of the head gap adjusting means are installed in the frame operatably from above the printer. Therefore, a printer is needless to move and the operation of adjusting head gap can be carried out in sequential handling which are easy and smooth, whereby operation efficiency is remarkably enhanced.

The head gap adjusting means and the securing means thereof can be constructed as follows. That is, the head gap adjusting means can comprise a rotatable cam rotatably mounted on the frame, a fixed cam fixed to a lower surface of the platen and vertically movable according to rotation of the rotatable cam, and a rotatable member rotatably mounted on the frame so as to be operable from above and engaging with the rotatable cam for rotation. The securing means can may be a securing member for unrotatablly securing the rotatable member directly to only the frame by operation from above.

In accordance with the above construction, by rotating the rotatable member from above, the rotatable cam rotates, whereby the platen vertically moves with the fixed cam, and thus adjustment of head gap is performed. Furthermore, by operating the securing member from above so as to secure the rotatable member, the rotatable cam is secured and the platen is secured at its adjusted position. In the invention, as the securing member is directly secured to only the frame, strain that occurred by the securing member does not easily affect the platen. As a result, the adjusted head gap is kept for long term in high precision.

The securing means can comprise an elastic member for elastically engaging to the rotatable member, thereby restricting rotation thereof In this construction, the rotatable member is ordinarily restricted by the securing means. Therefore, the step of securing the rotatable member can be omitted, whereby operations of adjusting head gap can be further facilitated.

These and other objects and advantages of the invention will become more apparent by referring to the following description and appended drawings.

DETAILED DESCRIPTION OF THE INVENTION

1. Embodiment

Figure 1:
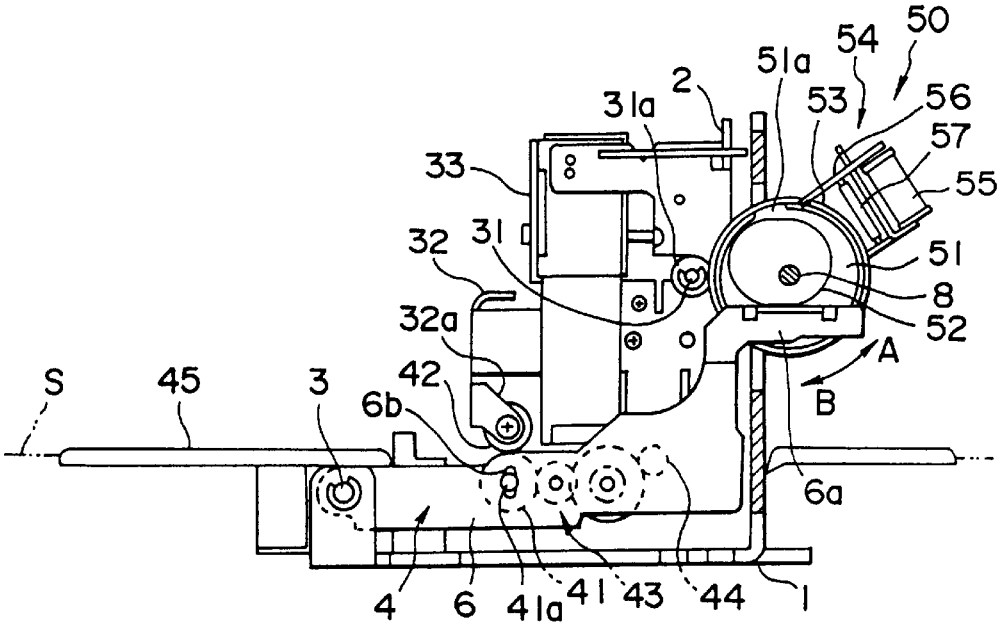
FIG. 1 is a side view showing an interior portion of a slip printer according to an embodiment of the invention.
Figure 2:
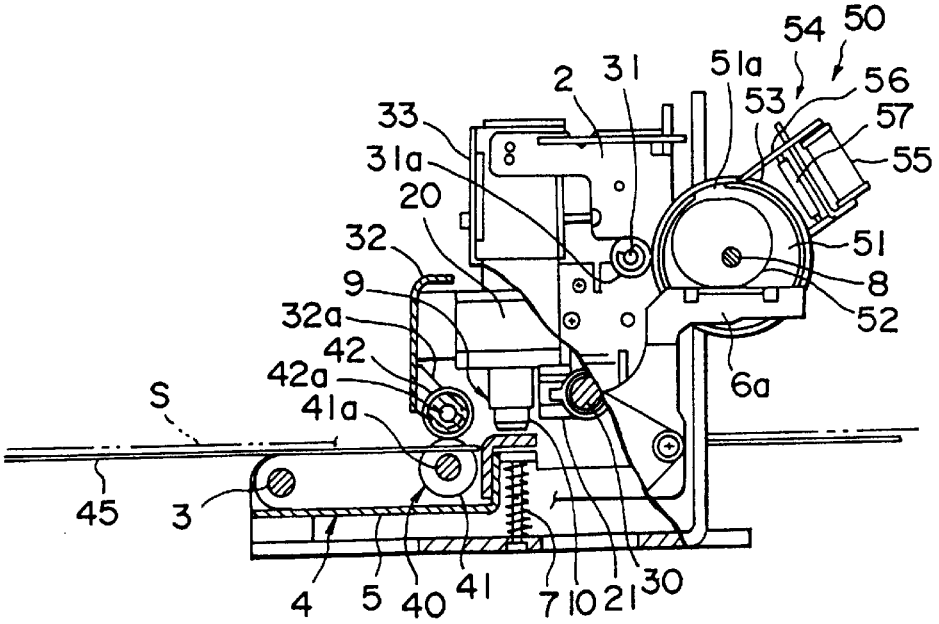
FIG. 2 is a partial cutaway side view showing an interior portion of the slip printer according to the embodiment of the invention.

FIG. 1 shows an internal side view of a slip printer according to the embodiment, wherein a cover forming an outer casing is removed therefrom. FIG. 2 shows a partially sectional side view of FIG. 1. In the figures, the left side thereof is the front portion of the slip printer, and the right side is the rear portion of the slip printer.

In the slip printer, the provided slip paper S is fed from the front portion toward the rear portion, and during this operation, the slip paper S is printed. In the following explanation, the description regarding the directions such as front and rear, left and right and up and down are the directions with respect to the slip printer except for specially noted case. Firstly, the entire structure of the slip printer may be explained.

A. Structure of the Slip Printer

Numeral 1 in FIGS. 1 and 2 indicates a chassis having an L-shaped side view. A fixed frame 2 is secured at the upper portion of the chassis 1. A rotatable shaft 3 extending right and left is supported at the front-end portion of the lower portion of the chassis 1. A swing frame 4 is mounted to the rotatable shaft 3 so as to swing up and down. The swing frame 4 consists of a main plate 5 and side plate portions 6 integrally formed with the main plate portion 5. An arm piece 6*a* extending toward the rear is formed at the rear end portion of the right side plate portion 6. As shown in FIG. 2, a compression spring 7 for normally upwardly biasing the swing frame 4 is mounted between the bottom portion of the chassis 1 and the rear end portion of the main plate portion 5, which is a swing end thereof A platen 10 extending right and left is fixed at the rear end portion of the swing frame 5. A dot impact type printing head 20 is mounted to the fixed frame 2 opposing just above the platen 10 so as to co-operate with the platen 10 for constructing a printing mechanism 9.

As shown in FIGS. 3 through 7, the platen 10 is an L-shaped plate-like member consisting of a horizontal plate portion 11 and a vertical plate portion 12. A printing area surface 11*a* for substantially receiving the dot impact from the printing head 20 is formed on the upper surface of the horizontal plate portion 11 which is parallel to the main plate portion 5 of the swing frame 4. As shown in FIG. 2, the printing head 20 is carried on a carriage 21. As shown is FIG. 4, a given head gap G is established between a head surface 20*a* disposed at the lower end of the printing head 20 and the printing area surface 11*a*. As shown in FIG. 2, the fixed frame 2 is installed with a transporting shaft 30, which supports the carriage 21 in reciprocal sliding connection toward right and left. The carriage 21 is moved reciprocally along the transporting shaft 30 by virtue of the rotation of the carriage driving shaft 31 driven by a carriage motor (not shown). That is, the printing head 20 reciprocally moves right and left along and above the platen 10.

As shown in FIGS. 1 and 2, the fixed frame 2 is mounted with a head cover 32, which covers the front of the printing head 20 reciprocally moving. The head cover 32 functions as heat radiant and protection for the printing head 20. In the rear of the head cover 32, an ink ribbon cassette 33 is removably attached to the front upper end portion of the fixed frame 2. The ink ribbon cassette 33 is designed so as to cover from above the moving area of the printing head 20. The ink ribbon cassette 33 contains an ink ribbon (not shown) therein. The ink ribbon is drawn out between both ends of the lower end portion of the ink ribbon cassette 33, and is lied between the printing head 20 and the slip paper S provided on the platen 10.

Figure 3:
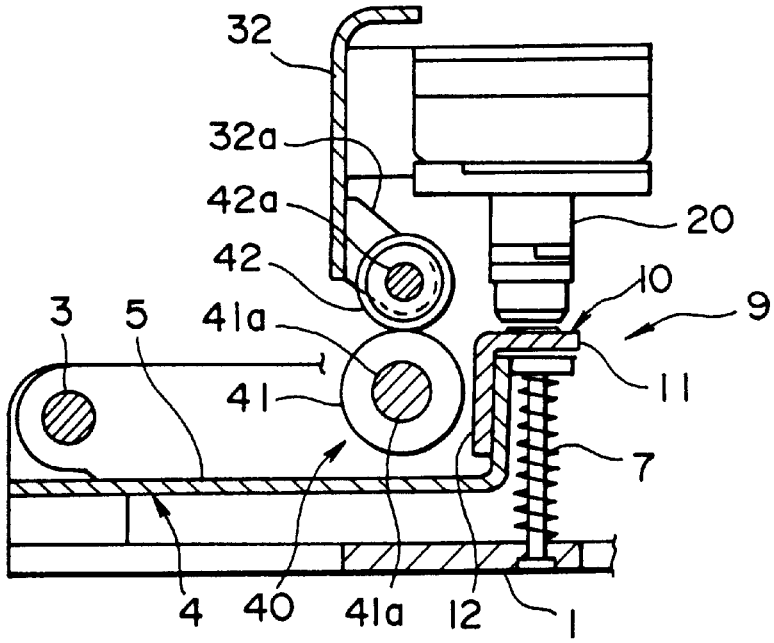
FIG. 3 is a side view showing a printing mechanism and a part of feed mechanism of the slip printer according to the embodiment of the invention.

As shown in FIGS. 1 through 3, in the front of the printing mechanism 9, a feed mechanism 40 for feeding the slip paper S is provided. The feed mechanism 40 comprises a driving roller 41 and a driven roller 42 that is disposed just above and parallel to the driving roller 41.

The driving roller 41 is mounted to a driving shaft 41*a* that is extended between both the side plate portions 6 of the swing frame 4 and can swing therewith. As shown in FIG. 1, both the end portions of the driving shaft 41*a* are inserted into vertically elongated slots 6*b* formed at both the side plate portions 6, so that the driving shaft 41*a* is movably supported toward the vertical direction along the slots 6*b*. The right end portion of the driving shaft 41*a* is coupled to a driving shaft 44 of a feed motor (not shown) via a gear arrangement 43. The feed motor is mounted to the outer surface of the right side plate portion 5 of the swing frame 4. On the other hand, the driven roller 42 is mounted to a driven shaft 42*a*, which is rotatably supported by side plate portions 32*a* formed at the lower end portion of the head cover 32. In the feed mechanism 40 as such constructed as above, when the swing frame 4 is upwardly pushed by the compression spring 7, the driving roller 41 is urged to contact the driven roller 42 in a suitable pressure, and driving force of the feed motor is transmitted to the driving roller 41*a* via the gear mechanism 43, so that both the rollers 41, 42 rotate to the feeding direction. In this case, the slip paper S is provided between both the rollers 41 and 42 then is fed toward the printing mechanism 9. The chassis 1 is installed with a guide table 45 for introducing the slip paper S to the feed mechanism 40, in a way that the guide table 45 is put between the fixed frame 2 and the swing frame 4.

As shown in FIG. 1, a swing control mechanism 50 for controlling the swing of the swing frame 4 is provided in the right side of the upper rear portion of the chassis 1.

The swing control mechanism 50 consists of a pair of cams (the first cam 51 and the second cam 52) which are integrated with each other and are rotatably attached to a rotatable shaft 8 provided to the chassis 1, a gear 53 and an electromagnetic coil unit 54 for controlling the rotation of the cams 51 and 52. The gear 53 engages with a gear 31*a* fixed at the right end portion of the carriage driving shaft 31 so as to be rotated by the carriage motor. As shown in FIG. 1, the first cam 51 is disk-shaped, and has an engaging protrusion portion 51*a* on its peripheral outer surface. The first cam 51 is designed such that the relative rotation thereof toward the arrow A with respect to the gear 53 is allowed by way of a one-way clutch (not shown). The second cam 52 is a plate cam having a short diameter portion and a long diameter portion, and peripheral outer surface thereof contacts the upper surface of the arm piece 6*a* of the swing frame 4.

The electromagnetic coil unit 54 comprises a trigger magnet 55 and an actuator 56 which is driven by the trigger magnet 55. The actuator 56 is normally engaged with the engaging protrusion 51*a* of the first cam 51 by virtue of the compression force of a spring 57. In this condition, by virtue of the function of the one-way clutch put between the first cam 51 and the gear 53, the first and the second cams 51 and 52 idle with respect to the rotation of the gear 53. When the trigger magnet 55 is excited in the above condition, the actuator 56 is driven against the compression force of the spring 57, whereby the actuator 56 disconnects from the engaging protrusion 51*a* of the first cam 51. By virtue of this, the one-way clutch functions, whereby the first and the second cams 51 and 52 rotates with the gear 53 toward the direction of the arrow B from the condition showed in FIG. 1. As a result, the arm piece 6*a* is downwardly thrust by the long diameter portion of the second cam 52 and the swing frame 4 swings downwardly. By virtue of the downward swing of the swing frame 4, space is formed between the driving roller 41 and the driven roller 42. That is, the distance between the platen 10 and the printing head 20 becomes wider than the given head gap, thus the paper supply/paper discharge position is arranged. On the other hand, the condition shown in FIG. 1 is the printing position. In this condition, the actuator 56 of the electromagnetic coil unit 54 is engaged with the engaging protrusion 51*a* of the first cam 51. The outer surface of the short diameter portion of the second cam 52 abuts against the arm piece 6*a*, whereby the swing frame 4 is upwardly positioned and the given head gap is established for printing. The operation of the swing frame 4 as mentioned above is carried out by control means (not shown) through sensing supply of the slip paper S and printing operation.

B. Structure of the Head Gap Adjusting means and Securing Means

The platen 10 is provided with a head gap adjusting means for vertically moving the platen 10 with respect to the swing frame 4 and a securing means of the head gap adjusting means for maintaining the head gap. The structure of these will be explained with reference to FIGS. 4 through 9.

Figure 5:
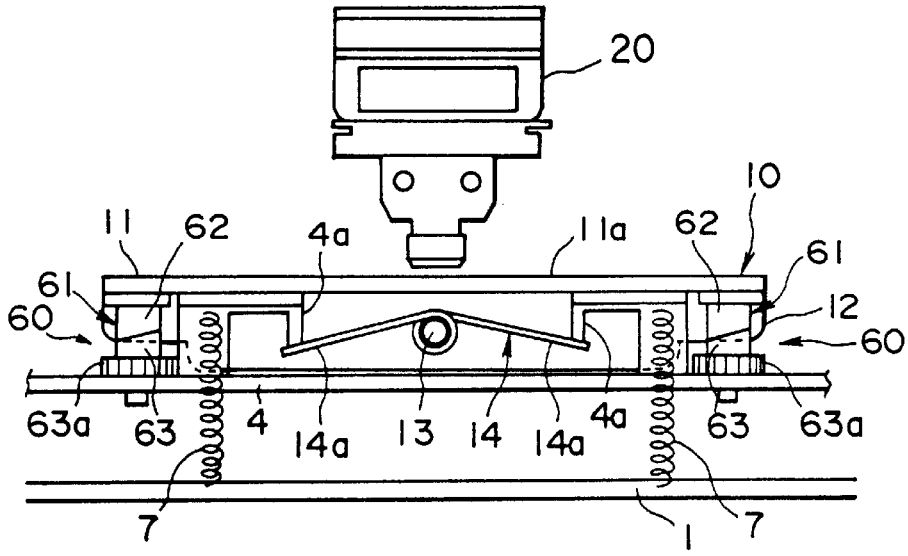
FIG. 5 is a back view showing a head gap adjusting means according to the embodiment of the invention.
Figure 6:
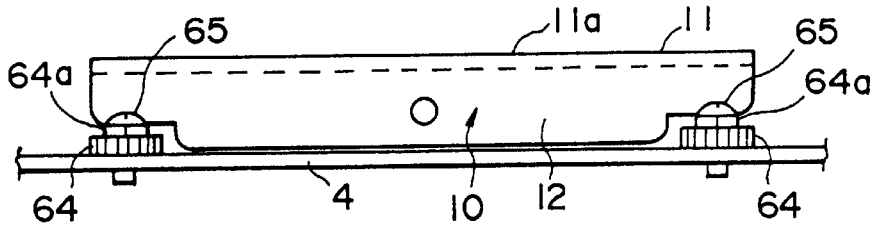
FIG. 6 is a front view showing the head gap adjusting means a securing means thereof according to the embodiment of the invention.

As shown in FIG. 5, a pin 13 projects from the inner center portion of the vertical plate portion 12 of the platen 10. The winding portion of a torsion coil spring 14 is mounted to the pin 13 with both arm portions 14*a* elastically engaged with engaging piece 4*a* which is integrally formed with the swing frame 4, whereby the platen 10 is normally biased toward downward the swing frame 4 side. Cylinder-shaped cam mechanisms 61 for vertically moving the platen 10 with respect to the swing frame 4 are put between the both end portions of the horizontal plate portion 11 of the platen 10 and the swing frame 4. The cam mechanism 61 consists of a fixed cam 62 which is fixed to the lower surface of the horizontal plate portion 11 and a rotatable cam 63 which is rotatably mounted to the swing frame 4. The cams 62 and 63 are disposed in a co-axial arrangement in which the axis thereof is perpendicular to the swing frame 4 and the horizontal plate portion 11. The cams 62 and 63 are formed with cam surfaces, which are inclined with respect to the axis thereof and are brought into contact with each other. The cam mechanism 61 is held between the horizontal plate potion 11 of the platen 10 and the swing frame 4 under a certain pressure by the force of the torsion coil spring 14.

Figure 8:
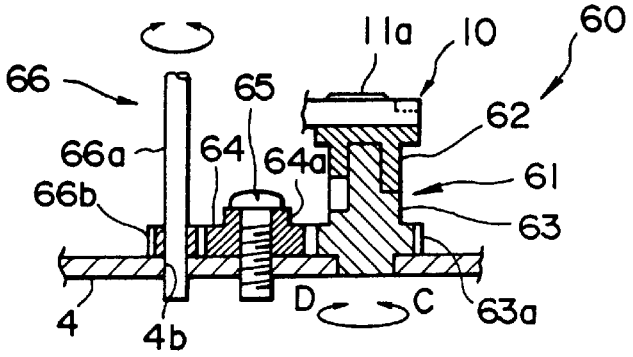
FIG. 8 is a view taken on line VIII—VIII.
Figure 9:
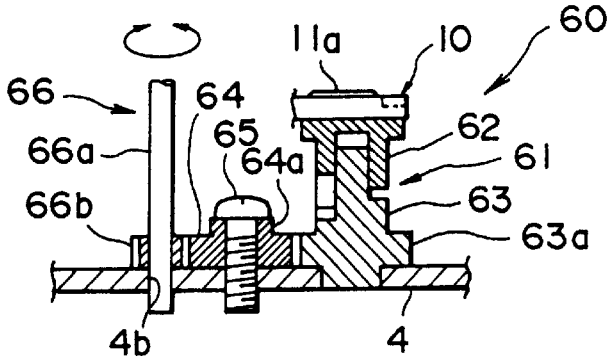
FIG. 9 is a cross sectional view in a condition in which the head gap adjustment means is operated from the condition in FIG. 8.

FIG. 8 shows a cross-sectional view of the cam mechanism 61 corresponding to the rotated position of the rotatable cam 63. By rotating the rotatable cam 63 toward the arrow C, the fixed cam 62 is pressed and lifted by the rotatable cam 63, whereby the platen 10 lifts. On the contrary, by rotating the rotatable cam 63 toward the arrow D, the platen 10 goes down by virtue of the force of the torsion coil spring 14. The vertical position of the platen 10 can be set according to amount of lift defined by the rotation of the rotatable cam 63.

As shown in FIGS. 5 throng 7, a driven gear 63*a* is integrally formed with the lower end of the rotatable cam 63. A driving gear (rotatable member) 64 engaging with the driven gear 63*a* is disposed in front of the rotatable cam 63. The driving gear 64 is rotatable around a securing screw (securing means or securing member) 65, which is screwed to the swing frame 4. The driving gear 64 is rotatable when the securing screw 65 is loosened, and the driving gear 64 is secured to the swing frame 4 when the securing screw 65 is tightened, thereby becoming unrotatable. When the driving gear 64 is secured, the rotatable cam 63, which is integrally formed with the driven gear 63*a*, is also secured. The upper surface of the driving gear 64 is formed with a hexagonal nut 64*a* co-axially therewith.

Figure 7:
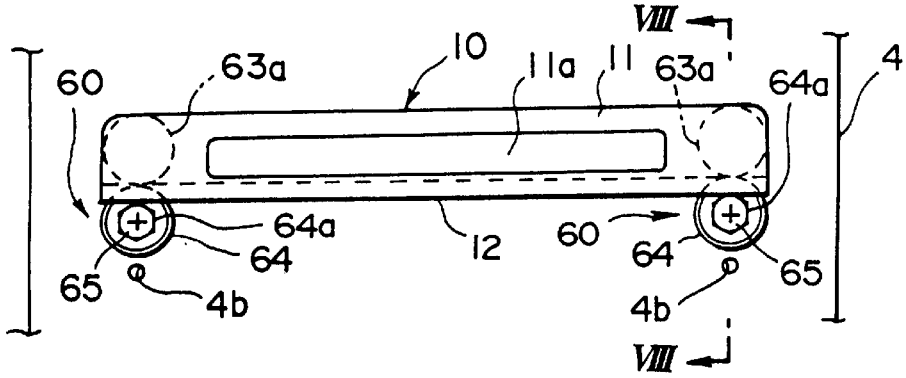
FIG. 7 is a top plan view showing the head gap adjusting means a securing means thereof according to the embodiment of the invention.

As shown in FIGS. 7 and 8, a jig hole 4*b* for inserting the front-end of an operating tool 66 is formed in front of the securing screw 65 of the swing frame 4. As shown in FIG. 8, the operating tool 66 consists of a relatively long rod 66*a*, a pinion 66*b* fixed at an end thereof and a handle (not shown) fixed at the other end of the rod 66*a*, thereby having a driver-like configuration. The operating tool 66 is used in a way that the front-end of the rod 66*a*, which projects from the pinion 66*b*, is inserted into the jig hole 4*b*, whereby the pinion 66*b* engages with the driving gear 64. Thereafter the operating tool 66 is rotated, whereby the rotation thereof transmits to the rotatable cam 63 via the pinion 66*b*, the driving gear 64 and the driven gear 63*a*. In order to enable to insert the rod 66*a* of the operating tool 66 into the jig hole 4*b* by operation from above, the upper part of the chassis 1 and the fixed frame 2 above the jig hole 4*b* may be opened. Alternatively, a slit or a hole for passing the operating tool 66 may be formed in the chassis 1 or the fixed frame 2. In the case of the embodiment, the head gap adjusting means 60 is constructed by the cam mechanism 61 and the driving gear 64, and the securing means of the head gap adjusting means for keeping a head gap is constructed by the securing screw 65 for securing the driving gear 64 to the swing frame 4.

2. Operation of the Embodiment

Operation and function of the slip printer as constructed as above will be explained in order of a printing operation and a method for adjusting a head gap.

A. Printing Operation of the Slip Printer

Before printing operation, the swing frame 4 is placed the downward paper supply/paper discharge position. At first, a sheet of slip paper S is put on the guide table 45 then is provided between the driving roller 41 and the driven roller 42 of the feed mechanism 40, and between the platen 10 and the printing head 20 of the printing mechanism 9. In accordance with the beginning of printing operation, the swing frame 4 is lifted to the printing position. Then, the slip paper S is clamped between the driving roller 41 and driven roller 42 possibly to be fed and between the platen 10 and the ink ribbon which contacts the printing head 20. Thereafter, a part of the slip paper S, which is put on the platen 10, is printed while the printing head 20 reciprocates right and left and the slip paper S is fed toward the rear by the feed mechanism 40. After completion of the printing, the swing frame 4 goes down to the paper supply/paper discharge position, whereby the slip paper S can be pulled out.

B. Adjustment of a Head Gap

Figure 4:
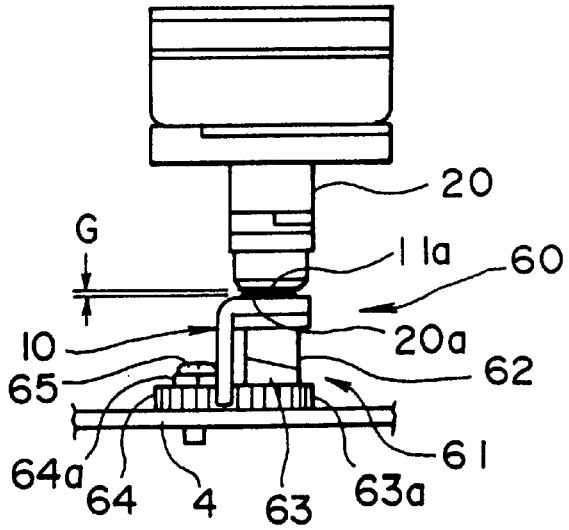
FIG. 4 is an enlarged side view showing a printing mechanism of the slip printer according to the embodiment of the invention.

Operation of adjusting a head gap between the platen 10 and the printing head 20 in the above slip printer will be explained hereinafter. Adjustment of a head gap is carried out as follows. The both ends of the platen 10 are vertically moved by the cam mechanisms 61. The distances between the upper surfaces of the above both ends and the printing head 20 (precisely, the head gap G defined between the head surface 20*a* and the printing area surface 11*a* as shown in FIG. 4) are measured by a clearance gage. When the given head gap is measured, the platen 10 is secured, whereby the adjustment is completed.

The concrete steps in the above adjustment are described hereinafter. At first, the securing screws 65 at the both ends are loosened so as to make the driving gears 64 to be rotatable, and the printing head 20 is moved to one of the both ends of the platen 10. Then the operating tool 66 is inserted into the slip printer from above, and the front-end thereof is inserted into the jig hole 4*b*, whereby the pinion 66*b* is engaged with the driving gear 64. Then the operating tool 66 is rotated, whereby the driving gear 64 and driven gear 63*a* are rotated. According to the rotation of the driven gear 63*a*, the rotatable cam 63 integrally formed with the driven gear 63*a* is rotated. According to direction and amount of the rotation of the rotational cam 63, the end of the platen 10 vertically moves with the fixed cam 62. Such operation is carried out clamping the clearance gage between the end of the platen 10 and the printing head 20, thereby measuring the head gap. When the given head gap is measured, rotation of the operating tool 66 is stopped. In this condition, the securing screw 65 is tightened with a tool such as driver, etc from above. Thus, the adjustment of the head gap at one end side is completed. Then the same adjustment is carried out with respect to the other end side of the platen 10. When the adjustment to the both ends of the platen 10 are completed, fine adjustment is carried out by the same operation according to the necessity, whereby the final adjustment is completed.

In the structure for adjusting a head gap as mentioned above, the cam mechanism 61 for vertically moving the platen 10 can be operated by rotating the operating tool 66 which is inserted into the jig hole 4*b* from above the slip printer. Furthermore, the platen 10 after the head gap is adjusted can be secured by tightening the securing screw 65 from above with the operating tool 66 held at the position, thereby securing the driving gear 64. As slip printers are precision apparatuses, they should not be inclined or reversed. Moreover as they have a certain weight each. Therefore, if operation of adjustment and securing a head gap is carried out from the reverse side of the slip printer, the operation may be remarkably troublesome. On the contrary in the embodiment, the head gap adjusting means 60 and the securing screw 65 are installed in the swing frame 4 operatably from above, so that a slip printer is needless to move on a working table. Therefore, the operation of adjusting a head gap can be carried out in sequential steps which are easy and smooth, whereby the operation efficiency is remarkably enhanced.

Moreover, as the driving gear 64 is directly secured to only the swing frame 4 by the securing screw 65, strain occurred in the swing frame 4 by the tightening force of the securing screw 65 is extremely small, whereby the strain does not affect the platen 10. And hence, the head gap after adjusted is precisely maintained in a long term.

The operation for adjusting a head gap may be carried out mainly by a manufacturer. When necessity to adjust a head gap occurs after sale at a market, the user may hardly have the operating tool 66. In this case, the user can rotate the driving gear 64 by engaging a small tool such as a wrench, etc., with the hexagonal nut 64*a*.

2. Another Embodiment

Figure 10:
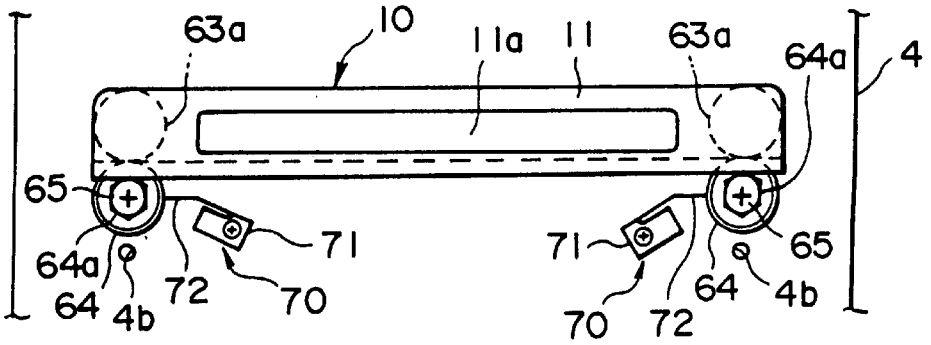
FIG. 10 is a top plan view showing a securing means according to another embodiment of the invention.

FIG. 10 shows another embodiment in accordance with the above-mentioned embodiment. In the embodiment, an elastic plate (securing means or elastic member) 70 is employed as a securing means for each driving gear 64. The elastic plate 70 is formed by bending a plate material having elasticity, consists of a rectangular bracket 71 and a click piece 72. The bracket 71 is secured by a screw in front of the platen 10 and at the inner side of the driving gear 64 in the swing frame 4. The front-end of the click piece 72 elastically engages with gear groove of the driving gear 64. In accordance with the embodiment, the operation for adjusting a head gap is the same as the above-mentioned embodiment. However in the embodiment, the click piece 72 engages with the gear grooves in order through elastically deforming according to rotation of the driving gear 64. The rotation of the driving gear 64 is restricted by engagement of the click piece 72 with the gear groove, whereby the rotatable cam 63 of the cam mechanism 61 stops and the platen 10 is secured. In this construction, the rotational shaft is not necessary to be the securing screw 65, it can be an ordinary pin.

In the embodiment as mentioned above, although the driving gear 64 is rotatable, it is ordinarily secured by the click piece 72 of the elastic plate 70, so that there is no need to secure the driving gear 64 with a special tool after adjusting a head gap. Therefore, the step of securing the driving gear 64 in its turn the platen 10 can be omitted, whereby the operation of adjusting a head gap can be further facilitated.

As clearly understood from the above description, the present invention is characterised by that the head gap adjusting means and the securing means thereof are installed in the frame both operatably from above. Therefore, the invention is not limited as long as the above structure is employed. For example, as a structure for vertically moving the platen, a combination of a gear and a screw or an arrangement of a crank mechanism can be employed instead of the cam mechanism. By virtue of directly securing a movable portion of the above mechanism to the frame, affect of aforementioned strain can be eliminated.

As mentioned above, in the invention, the head gap adjusting means and the securing means thereof, that are put between the frame and the platen are installed in the frame both operatably from above. Therefore, the operation of adjusting a head gap can be carried out in sequential steps which are easy and smooth, whereby the operation efficiency is remarkably enhanced.

Moreover, the head gap adjusting means is constructed with a combination of the fixed cam and the rotatable cam which is rotated by the rotatable member, the securing means is the securing member for unrotatably securing the rotatable member directly to the frame. Therefore, that strain occurred by the securing member does not affect platen, whereby the head gap after adjusted is precisely maintained in a long term.

In addition, the securing means is the elastic member for elastically contacting the rotatable member, thereby restricting rotation of the rotatable member. For this construction, although the rotatable member is rotatable, it is always kept secured by the elastic member, so that handling for securing is omitted, whereby the operation of adjusting a head gap can be further facilitated.

What is claimed is:

1. A printer comprising:

a frame;

a platen disposed above the frame;

a printing head disposed opposing above the platen with a given gap provided therebetween;

a head gap adjusting device disposed between the frame and the platen and at each longitudinal end of the platen, said head gap adjusting device including a rotatable cam rotatably mounted on said frame and a fixed cam fixed to a lower surface of the platen and vertically movable according to rotation of the rotatable cam, thereby providing the given gap between the platen and the printing head; and a securing device for the head gap adjusting device for fixing the gap;

wherein both said head gap adjusting and said securing device are provided on said frame so as to be manually operable by a tool from above the frame.

2. A printer according to claim 1, wherein said fixed cam and said rotatable cam have inclined surfaces with respect to a rotatable axis thereof, and the inclined surfaces contact each other.

3. A printer according to claim 1, wherein said tool has a rod and a pinion fixed at an end portion of the rod.

4. A printer comprising:

a frame;

a platen disposed above the frame;

a printing head disposed opposing above the platen with a given gap provided therebetween;

a head gap adjusting device disposed between the frame and the platen and at each longitudinal end of the platen, said head gap adjusting device including a rotatable cam rotatably mounted on said frame; a fixed cam fixed to a lower surface of the platen and vertically movable according to rotation of the rotatable cam; and a rotatable member rotatably mounted on the frame and engaging with the rotatable cam for rotation, thereby providing the given gap between the platen and the printing head; and a securing device for the head gap adjusting device for fixing the gap;

wherein both said head gap adjusting device and said securing device are provided on said frame so as to manually operable by a tool from above the frame.

5. A printer according to claim 4, wherein said fixed cam and said rotatable cam have inclined surfaces with respect to a rotatable axis thereof, and the inclined surfaces contact each other.

6. A printer according to claim 4, wherein said rotatable cam and said rotatable member are formed with gears engaging each other on peripheral surfaces thereof.

7. A printer according to claim 4, wherein said securing device comprises a securing member for non-rotatably securing the rotatable member directly to only the frame by manual operation from above the frame.

8. A printer according to claim 7, wherein said securing member is a screw penetrating said rotatable member.

9. A printer according to claim 4, wherein said tool has a rod and a pinion fixed at an end portion of the rod.

10. A printer according to claim 9, wherein said frame is formed with a hole in the vicinity of said rotatable member, an end portion of the rod is inserted into the bole so as to engage said pinion with the rotatable member.

11. A printer comprising:

a frame;

a platen disposed above the frame;

a printing head disposed opposing above the platen with a given gap provided therebetween;

a head gap adjusting device disposed between the frame and the platen and at each longitudinal end of the platen, for moving up and down the platen to position it with respect to the printing head, thereby providing the given gap therebetween; and a securing device for the head gap adjusting device for fixing the gap;

wherein said head gap adjusting device comprises a rotatable cam rotatably mounted on the frame;

a fixed cam fixed to a lower surface of the platen and vertically movable according to rotation of the rotatable cam; and a rotatable member which is rotatably mounted on the frame so as to be manually operable by a tool from above the frame for adjusting the gap;

said rotatable cam and said rotatable member are formed with gears engaging each other on peripheral surfaces thereof; and said securing device comprises an elastic member for elastically engaging with the gear of the rotatable member so as to restrict rotation of the rotatable member.

* * * * *